US005314021A

United States Patent [19]

Potier et al.

[11] Patent Number: 5,314,021

[45] Date of Patent: May 24, 1994

[54] HEAT EXCHANGER WITH A PLURALITY OF RANGES OF TUBES, IN PARTICULAR FOR A MOTOR VEHICLE

[75] Inventors: Michel Potier, Rambouillet; Philippe Le Gauyer, Paris, both of France

[73] Assignee: Valeo Thermique Moteur, Le Mesnil-Saint-Denis, France

[21] Appl. No.: 853,640

[22] Filed: Mar. 18, 1992

[30] Foreign Application Priority Data

Mar. 20, 1991 [FR] France ..... 91 03411

[51] Int. Cl.[5] ..... F28D 1/053; F28F 9/04

[52] U.S. Cl. ..... 165/153; 165/172; 165/173

[58] Field of Search ..... 165/153, 173, 152, 172, 165/151; 29/890.043, 890.052, 890, 054

[56] References Cited

U.S. PATENT DOCUMENTS

| | | | |
|---|---|---|---|
| 2,655,181 | 10/1953 | Cooper | 165/152 |
| 3,118,498 | 1/1964 | Bergdoll et al. | 165/153 |
| 3,627,039 | 12/1971 | Tiefenbacher | 165/172 |
| 3,708,012 | 1/1973 | Zimprich | 29/890.043 |
| 3,907,032 | 9/1975 | DeGroote et al. | 165/166 |
| 4,183,402 | 1/1980 | Cotter | 29/890.052 |
| 4,332,291 | 6/1982 | Mulock-Bentley | 165/153 |
| 4,738,311 | 4/1988 | Bleckman | 165/172 |
| 4,771,825 | 9/1988 | Chen et al. | 165/172 |
| 4,825,941 | 5/1989 | Hoshino et al. | 165/153 |
| 4,881,594 | 11/1989 | Beamer et al. | 165/173 |

FOREIGN PATENT DOCUMENTS

| | | | |
|---|---|---|---|
| 1014134 | 8/1957 | Fed. Rep. of Germany | 165/172 |
| 3327335 | 7/1983 | Fed. Rep. of Germany . | |
| 60-105893 | 6/1985 | Japan . | |
| 161394 | 7/1988 | Japan | 165/173 |
| 661464 | 11/1983 | Switzerland . | |
| 548994 | 11/1942 | United Kingdom | 165/151 |
| 2075173 | 11/1981 | United Kingdom | 165/173 |

*Primary Examiner*—John Rivell
*Assistant Examiner*—L. R. Leo
*Attorney, Agent, or Firm*—Morgan & Finnegan

[57] ABSTRACT

A heat exchanger comprises a bundle of parallel tubes disposed in ranges and having respective end portions, each of which is received in a collecting plate which is formed with holes. These holes may be bounded by lips. Each hole in the collecting plate receives the respective end portions of a pair of adjacent tubes forming part of different ranges of the tube bundle. These ranges are arranged back-to-back, but leaving at each side of the interface between the tubes a small free space within the hole of the collecting plate. A pair of opposed beak-like projections are formed on the edge of each hole so as to fill this free space. The pitch defined between two tubes in two adjacent ranges is reduced to a minimal value so as to optimize the performance of the heat exchanger, with a minimal width of the collecting plate.

1 Claim, 2 Drawing Sheets

HEAT EXCHANGER WITH A PLURALITY OF RANGES OF TUBES, IN PARTICULAR FOR A MOTOR VEHICLE

FIELD OF THE INVENTION

This invention relates to a heat exchanger of the kind comprising a bundle of parallel tubes disposed in ranges and having respective end portions which are received in a collecting plate formed with holes, which may be bounded by lips.

BACKGROUND OF THE INVENTION

Such heat exchangers are used especially in motor vehicles having internal combustion engines, either for engine cooling purposes or for heating the cabin of the vehicle. An engine coolant fluid flows through the tubes in the bundle, while air circulates around the tubes. In certain cases, the tubes have a non-circular cross section, and in particular a flattened cross section which is generally oval, elliptical or oblong, such as to reduce the loss of kinetic energy in the air flow passing through the heat exchanger and to optimise its thermal performance to some extent.

In the known heat exchangers of this type the same number of holes is provided in the collecting plate as there are tubes in the bundle, so that each tube end portion is received individually in a separate hole in the collecting plate and is sealingly joined to the collecting plate, and in particular to the above mentioned lip surrounding the relevant hole, if such a lip is provided. The collecting plate (which is also known as a perforated plate) is generally made in the form of a metallic plate in which are formed both the holes and the corresponding lips. The seal between each end portion of a tube and the corresponding lip of the collecting plate is then achieved either by interposing a compressible sealing element or by direct brazing, with the tube then being provided with a metallic coating having a low melting point. Since these heat exchangers comprise a plurality of series of tubes, the collecting plate must also include a plurality of ranges of holes which are separated from each other by a given pitch distance within any given series, and by a further given pitch distance as between one series of holes and the next. There thus exists between two consecutive holes in the collecting plate a thickness of material which, for reasons of mechanical strength of the collecting plate, must not be less than a certain minimum value. This minimum value is also essential in order to enable any lips to be formed around the holes in the collecting plate.

As a consequence, it has not hitherto been possible to realise the potential for optimisation of the dimensions of the tubes and their pitches, and therefore the optimisation of the thermal performance of the heat exchanger, for a given set of dimensions of collecting plate.

DISCUSSION OF THE INVENTION

A principal object of the invention is to overcome the above mentioned drawbacks. It therefore provides a heat exchanger of the kind comprising a bundle of parallel tubes disposed in ranges, the end portions of which are received in a collecting plate which is formed with holes, which may optionally be surrounded by lips.

According to the invention, there is provided a heat exchanger of the kind comprising a bundle of tubes disposed in ranges and having respective end portions which are received in a collecting plate formed with holes, characterised in that each hole of the collecting plate receives the respective end portions of a plurality of adjacent tubes, and in that the end portions of the adjacent tubes received in any one said hole are brazed directly in the said hole. With this arrangement the pitch between the tubes can be reduced to a minimal value. It is thus possible to optimise the heat exchanger performance, and with minimal dimensions of the collecting plate.

Since each hole in the collecting plate receives the end portions of several tubes, and since it may also be surrounded by a lip, the collecting plate is thus made more rigid, which leads to improved retention of the end portions of the tubes under compression.

Preferably, the end portions of the tubes are flattened, and the cross section of the hole corresponds to that of the combined cross sections of the end portions of the tubes in the hole.

In a preferred form of heat exchanger according to the invention, each said hole has a generally oblong cross section delimited by two straight, parallel sides and two semi-circular sides.

The invention is applicable in particular to the case where the collecting plate has lips around the holes, but is not restricted to that case.

A preferred embodiment of the invention will be described below, by way of example only and with reference to the accompanying drawings.

DESCRIPTION OF A PREFERRED EMBODIMENT OF THE INVENTION

Figure 2:
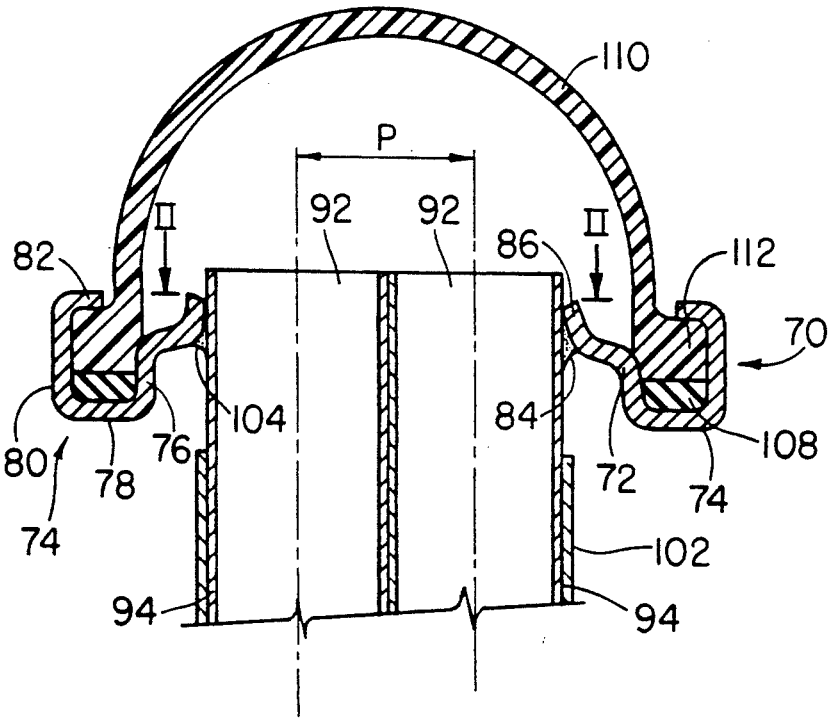
FIG. 2 is a view in transverse cross section taken on the line I—I in FIG. 1.
Figure 3:
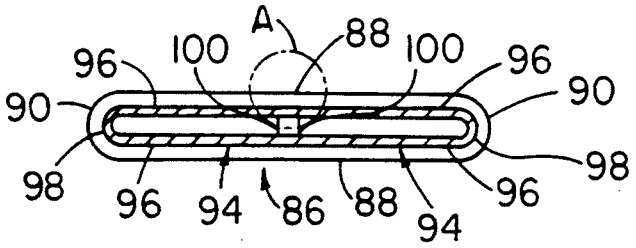
FIG. 3 is a view in cross section taken on the line II—II in FIG. 2.

The heat exchanger shown in the drawings comprises a metallic collecting plate 70 of generally rectangular shape, comprising a spine portion 72 having two longitudinal side edges 74, as best seen in FIG. 2. Each longitudinal side edge 74 comprises a portion 76 which extends tends at right angles with respect to the plane of the spine portion 72, a portion 78 which extends at right angles to the portion 76, and a portion 80 which extends at right angles to the portion 78. The free edge of the portion 80 is formed with tabs 82 adapted to be bent over into the position shown in FIG. 2. The spine portion 72 is formed with a number of elongated oblong holes 84, the larger dimension of which extends at right angles to the two larger sides of the collecting plate. Each of the holes 82 is surrounded by an oblong lip 86 which is delimited by two straight parallel edges 88 and two semi-circular edges 90 (FIG. 3). The holes 84 are spaced apart in pairs by a pitch distance E, and each hole 84 is arranged to receive the respective end portions 92 of two heat exchanger tubes 94 which are fitted to the collecting plate and which form part of two adjacent ranges of tubes in the heat exchanger.

In this example the tubes 94 are of the "flat" type, the cross section of which is defined by two flat parallel portions joined together by means of two semi-circular, rounded portions as shown in FIG. 2. The two adjacent tubes 94 define a tube pitch P indicated in FIGS. 2 and 3. The end portions 92 of the tubes 94 are slightly deformed in such a way that each end portion is delimited by two flat, parallel portions 96, a semi-circular portion 98 and a short, flat portion 100 (see FIGS. 3 and 4). Thus, the two end portions 92 received in any one of the holes 84 are attached through their short edges 100, their respective portions 98 being located at the outer sides of the pair of tubes. The tubes 94 are of a suitable metal, and are plated with a metal having a low melting point such as to enable the two end portions 92 to be brazed into the lip 86 of a hole 84.

Figure 1:
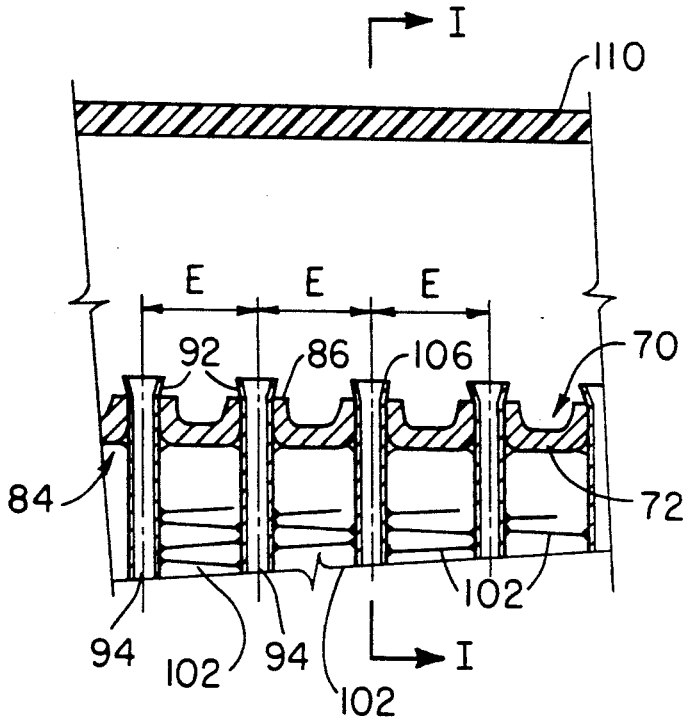
FIG. 1 is a view in longitudinal cross section of part of a heat exchanger, the tubes of which are brazed on a collecting plate.

In order to assemble the heat exchanger, a bundle is first formed, comprising a multiplicity of pairs of tubes 94, between which cooling fins 102 of sinusoidal shape (as seen in FIG. 1) are disposed. The end portions 92 of the tubes in the bundle are then introduced in pairs into the corresponding holes 84 in the collecting plate 70. The end portions 92 are subsequently reformed into the shape shown in FIG. 3, and are slightly opened out at the ends as indicated at 106 in FIG. 1. The assembly is then brazed together by forming a brazed joint 104 resulting from melting of the metallic alloy covering the tube walls. An annular sealing gasket 108 is then placed over the whole periphery of the collecting plate 70; and in the groove thus obtained, the peripheral bead 112 of a wall 110 is placed in order to complete a water box or manifold. The tabs 82 are then turned over as shown in FIG. 2 so as to put the sealing gasket 108 into compression and secure the water box wall 110 sealingly to the collecting plate 70.

Figure 4:
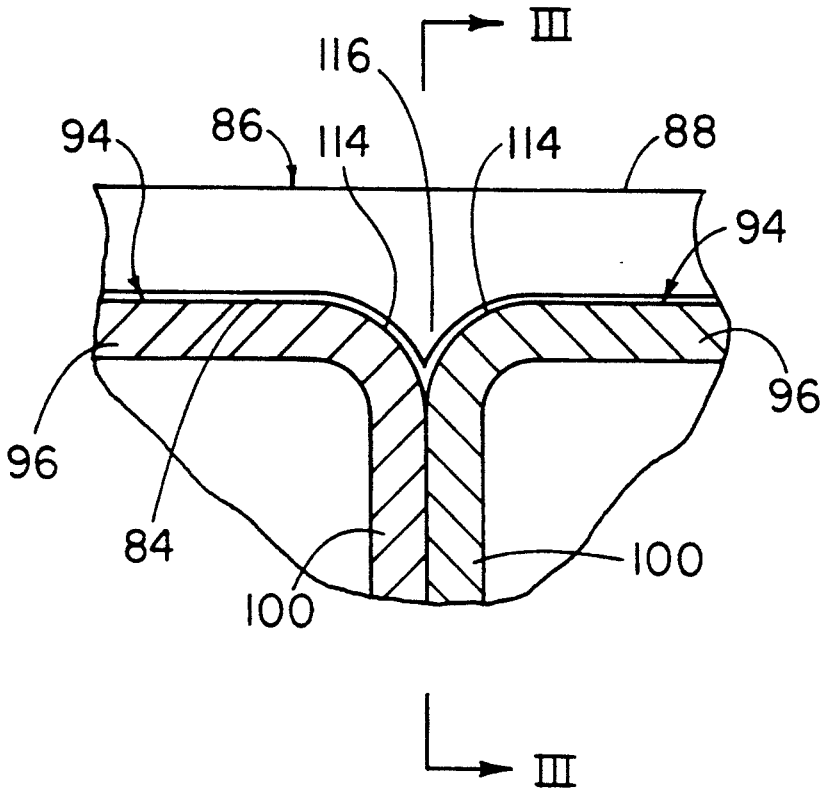
FIG. 4 is a view on a larger scale of the detail indicated at A in FIG. 3.
Figure 5:
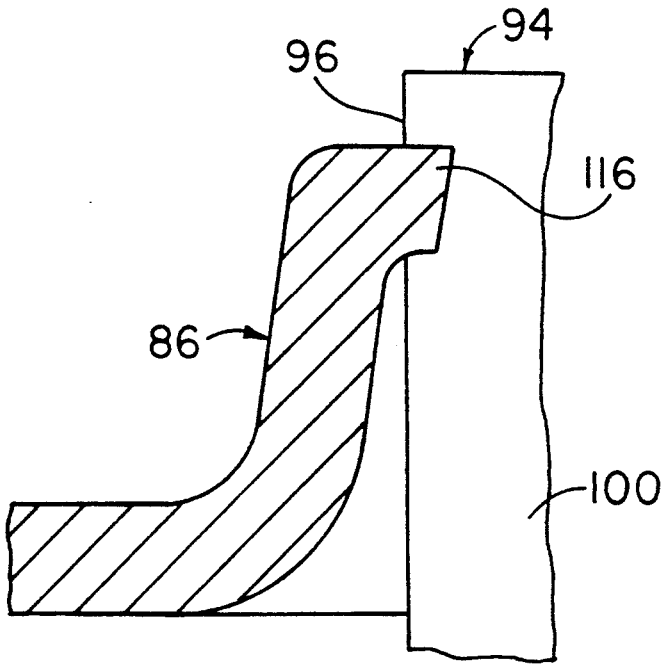
FIG. 5 is a scrap view in partial cross section taken on the line III—III in FIG. 4.

In practice it is difficult to attach the two flat edges 96 directly at a right angle with the short flat edge 100 of a tube 94, and therefore there always exists a rounded edge 114 of small radius, which is indicated in FIG. 4. In consequence, after introduction of the end portions 92 of the two tubes 94 into the hole 84 surrounded by the lip 86, there will normally be obtained an empty or free space between the lip 86 and the two rounded edges 114 of the tubes. This empty space becomes more difficult to fill with brazing metal, the larger is the radius of curvature of the rounded edges 114. In order to overcome this disadvantage, the hole 84 includes a beak-shaped projection 116 which is formed on the lip 86 and which is arranged to fit the shape of the two rounded edges 114 at the interface between the tubes 94. The hole 84 does in fact have two of these beak-shaped projections 116 arranged facing each other, so as to project from the two edges 88 of the lip 86 and so fill the space defined between the ends 92 of two adjacent tubes 94.

The other end of the tube bundle is preferably provided with a similar collecting plate.

Although the invention has been described above with reference to tubes of non-circular cross section, it will be understood that it is equally applicable where the tubes are of circular cross section, the holes in the collecting plate then being adapted appropriately as to their shape.

It will be realized that with the arrangement described above according to the invention, the heat exchanger can be made with a minimal pitch P between two tubes in two adjacent ranges of the tube bundle. This enables the thermal performance of the heat exchanger to be optimized for a minimal width of the collecting plate, while at the same time improving the mechanical integrity of the tubes under pressure.

We claim:

1. A heat exchanger comprising:

a plurality of rows of tube members, each tube member having an end portion, each tube end portion having a cross-sectional area;

a closed manifold for containing a heat exchange fluid, said manifold having a wall portion which is constituted by a collecting plate having a plurality of holes, each of said holes defining a lip, each hole receiving the respective end portions of two of said tube members, each tube member of said two tube members in a respective hole having a wall member directly abutting a wall member of said other tube member in said respective hole, wherein each said hole has two straight, parallel edges and two semi-circular edges, together defining for the hole a generally oblong cross section, each tube end portion being generally oblong in cross-sectional area having a pair of parallel longitudinal wall members, a first semi-circular end wall member, a second substantially flat transverse wall member which defines one of said directly abutting tube wall members, said end portions of said tubes being deformed to engage said respective lip wherein each of said abutting second, substantially flat transverse wall members further include a pair of arcuate corner wall portions, each corner wall portion of each respective tube member in a hole being directly adjacent to a corner wall portion of the abutting wall member of another tube member in the hole and defining a space between abutting wall members of the tube members in a hole, said collecting plate further including a plurality of beak-shaped projection members, each projection member defining part of the contour of the corresponding hole substantially filling each said space defined between abutting tube wall members in a hole.

* * * * *